US006322200B1

(12) United States Patent
Feinn et al.

(10) Patent No.: US 6,322,200 B1
(45) Date of Patent: Nov. 27, 2001

(54) DECOUPLED NOZZLE PLATE AND ELECTRICAL FLEXIBLE CIRCUIT FOR AN INKJET PRINT CARTRIDGE

(75) Inventors: James A Feinn; Ali Emamjomeh, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/431,974

(22) Filed: Oct. 29, 1999

(51) Int. Cl.[7] ..... B41J 2/05
(52) U.S. Cl. ..... 347/58; 347/50; 347/87
(58) Field of Search ..... 347/58, 50, 87

(56) References Cited

U.S. PATENT DOCUMENTS

| | | | |
|---|---|---|---|
| 4,313,684 | | 2/1982 | Tazaki et al. . |
| 4,490,728 | | 12/1984 | Vaught et al. . |
| 5,278,584 | | 1/1994 | Keefe et al. . |
| 5,291,226 | | 3/1994 | Schantz et al. . |
| 5,442,384 | | 8/1995 | Schantz et al. . |
| 5,442,386 | * | 8/1995 | Childers et al. ..... 347/50 |
| 5,450,113 | | 9/1995 | Childers et al. . |
| 5,648,805 | | 7/1997 | Keefe et al. . |
| 5,736,998 | | 4/1998 | Caren et al. . |
| 5,852,460 | | 12/1998 | Schaeffer et al. . |
| 6,071,427 | * | 6/2000 | Raulinaitis ..... 347/50 X |

* cited by examiner

*Primary Examiner*—David F. Yockey
(74) *Attorney, Agent, or Firm*—Dennis G. Stenstrom

(57) ABSTRACT

An inkjet printhead which includes a substrate having a plurality of individual ink ejection chambers defined by a barrier layer formed on a first surface of said substrate and having an ink ejection element formed on the first surface of said substrate in each of said ink ejection chambers, said ink ejection elements electrically connected to electrodes on said substrate. The printhead further includes a nozzle member constructed of a first material having a predetermined thickness and having a plurality of nozzles formed therein, said nozzle member overlaying and affixed to said barrier layer such that said nozzles align with said ink ejection chambers and said ink ejection elements, said nozzle member including openings aligned with and exposing the electrodes on said substrate and a flexible circuit constructed of a second material and having electrical traces formed thereon, said flexible circuit overlying and affixed to said nozzle member such that a first opening therein exposes said plurality of nozzles, said flexible circuit including second openings therein for exposing the electrical traces bonded to the electrodes, said second openings on said flexible circuit aligned with said nozzle member openings; and an encapsulant in the openings of said nozzle member and the second openings of said flexible circuit for protecting said electrical traces and electrodes.

18 Claims, 9 Drawing Sheets

DECOUPLED NOZZLE PLATE AND ELECTRICAL FLEXIBLE CIRCUIT FOR AN INKJET PRINT CARTRIDGE

CROSS-REFERENCE TO RELATED APPLICATIONS

This application relates to the subject matter disclosed in the following U.S. Patent Application and U.S. Patents:

U.S. Pat. No. 6,359,463, entitled "Multi-Drop Merge on Media Printing System;"

U.S. Pat. No. 6,234,613, entitled "Apparatus for Generating Small Volume, High Velocity Ink Droplets in an Inkjet Printer;"

U.S. Pat. No. 5,852,460, entitled "Inkjet Print Cartridge Design to Decrease Deformation of the Printhead When Adhesively Sealing the Printhead to the Print Cartridge."

U.S. Pat. No. 5,736,998, entitled "Inkjet Cartridge Design for Facilitating the Adhesive Sealing of a Printhead to an Ink Reservoir;"

U.S. Pat. No. 5,450,113, entitled "Adhesive Seal for an Inkjet Printhead;"

U.S. Patent Application Ser. No. 09/302,837, filed Apr. 30, 1999, entitled "Inkjet Print Cartridge Design to Decrease Ink Shorts Due to Ink Penetration of the Printhead;"

U.S. Pat. No. 6,244,696, entitled "Inkjet Print Cartridge Design for Decreasing Ink Shorts By Using an Elevated Substrate Support Surface to Increase Adhesive Sealing of the Printhead from Ink Penetration;"

U.S. Pat. No. 5,442,384, entitled "Integrated Nozzle Member and TAB Circuit for Inkjet Printhead;"

U.S. Pat. No. 5,278,584, entitled "Ink Delivery System for an Inkjet Printhead;"and U.S. Pat. No. 5,291,226, entitled "Nozzle Member Including Ink Flow Channels."

The above patents are assigned to the present assignee and are incorporated herein by reference.

FIELD OF THE INVENTION

The present invention generally relates to inkjet printers and, more particularly, to the printhead portion of an inkjet print cartridge.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of ejection chambers which receive liquid ink from the ink reservoir. Each chamber has a thin-film ink ejection element, known as a inkjet ejection chamber ink ejection element, located opposite the nozzle so ink can collect between it and the nozzle. The ejection of ink droplets is typically under the control of a microprocessor, the signals of which are conveyed by electrical traces to the ink ejection element elements. When electric printing pulses heat the inkjet ejection chamber ink ejection element, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

In U.S. Pat. No. 5,442,384, entitled "Integrated Nozzle Member and TAB Circuit for Inkjet Printhead," a novel nozzle member for an inkjet print cartridge and method of forming the nozzle member are disclosed. A flexible circuit tape having conductive traces formed thereon has formed in it nozzles or orifices by Excimer laser ablation. The resulting flexible circuit having nozzles and conductive traces may then have mounted on it a substrate containing heating elements associated with each of the nozzles. The conductive traces formed on the back surface of the flexible circuit are then connected to the electrodes on the substrate and provide energization signals for the heating elements. A barrier layer, which may be a separate layer or formed in the nozzle member itself, includes ejection chambers, surrounding each orifice, and ink flow channels which provide fluid communication between a ink reservoir and the ejection chambers.

In U.S. Pat. No. 5,648,805, entitled "Adhesive Seal for an inkjet Printhead," a procedure for sealing an integrated nozzle and flexible or tape circuit to a print cartridge is disclosed. A nozzle member containing an array of nozzles has a substrate, having heater elements formed thereon, affixed to a back surface of the flexible circuit. Each orifice in the flexible circuit is associated with a single heating element formed on the substrate. The back surface of the flexible circuit extends beyond the outer edges of the substrate. Ink is supplied from an ink reservoir to the nozzles by a fluid channel within a barrier layer between the flexible circuit and the substrate. In either embodiment, the flexible circuit is adhesively sealed with respect to the print cartridge body by forming an ink seal, circumscribing the substrate, between the back surface of the flexible circuit and the body. This method and structure of providing a seal directly between a flexible circuit and an ink reservoir body has many advantages. Also, in U.S. Pat. No. 5,736,998, entitled "Inkjet Cartridge Design for Facilitating the Adhesive Sealing of a Printhead to an Ink Reservoir," and U.S. Pat. No. 5,852,460, entitled "Inkjet Print Cartridge Design to Decrease Deformation of the Printhead When Adhesively Sealing The Printhead to the Print Cartridge;" improved headland designs are disclosed which alleviate some of the above-mentioned problems.

Flexible circuit leads are bonded to pads or electrodes on the outer edges of the substrate. To enable this bonding, a window is created in the flexible circuit to allow a bonder thermode to apply force and temperature to the flexible circuit leads that are resting on the bond pads. After the leads have been bonded, an encapsulant is dispensed across the window to protect the exposed bond pad region from intrusion of ink or contamination.

By providing the nozzles in the flexible circuit itself, the shortcomings of conventional electroformed nozzle members are overcome. This integrated nozzle and tab circuit design is superior to the nozzle members for inkjet printheads formed of nickel and fabricated by lithographic electroforming processes.

In U.S. Pat. No. 5,450,114, entitled "Adhesive Seal for an Inkjet Printhead," a procedure for sealing an integrated nozzle and tab circuit to a print cartridge is disclosed. See also U.S. Pat. No. 5,736,958, entitled "Inkjet Cartridge Design for Facilitating the Adhesive Sealing of a Printhead to an Ink Reservoir."

However, the above designs did not address the problem of "dimples" being formed in the nozzle member caused by bending of the nozzle member due to the stresses created by the adhesive process of sealing the nozzle member to the print cartridge. This dimpling of the nozzle member creates nozzles which are skewed causing trajectory errors for the ejected ink droplets from the nozzles. When the TAB head assembly is scanned across a recording medium the ink trajectory errors will affect the location of printed dots and thus affect the quality of printing.

In a typical edge-feed inkjet printhead assembly 14 the flexible circuit 18 serves as both an nozzle member 16 and as a carrier of the conductor traces 36. There are several fundamental problems with this design approach. First, the conductor traces 36 must be protected with a cover layer 38 to prevent electrical shorting and corrosion and it is difficult to design a cover layer 38 and an adhesive 90 that is resistant to a wide range of inks and also has good adhesion to both the print cartridge 10 body and the flexible circuit 18 material. Second, most head-to-body adhesives de-laminate from the flexible circuit over time. When this occurs, inks can readily penetrate the cover layer adhesive and cause electrical shorting and corrosion. Third, on edge-feed print cartridges, there is an unprotected region between the edge of the cover layer and the substrate. Here, the conductor traces are susceptible to shorting and corrosion if ink penetrates between the structural adhesive and the flexible circuit. This gap is necessary because of the cover layer placement tolerances in manufacturing. The nozzle member material, thickness, and manufacturing processes cannot be optimized independently from that of the flexible circuit, even though each has very different functional requirements.

Accordingly, it would be advantageous to have an improved printhead design which reduces dimpling of the nozzle member and ink penetration and shorting of the substrate electrodes and flexible circuit leads.

SUMMARY OF THE INVENTION

In accordance with the present invention an inkjet printhead includes a substrate having a plurality of individual ink ejection chambers defined by a barrier layer formed on a first surface of said substrate and having an ink ejection element formed on the first surface of said substrate in each of said ink ejection chambers, said ink ejection elements electrically connected to electrodes on said substrate. The printhead further includes a nozzle member constructed of a first material having a predetermined thickness and having a plurality of nozzles formed therein, said nozzle member overlaying and affixed to said barrier layer such that said nozzles align with said ink ejection chambers and said ink ejection elements, said nozzle member including openings aligned with and exposing the electrodes on said substrate and a flexible circuit constructed of a second material and having electrical traces formed thereon, said flexible circuit overlying and affixed to said nozzle member such that a first opening therein exposes said plurality of nozzles, said flexible circuit including second openings therein for exposing the electrical traces bonded to the electrodes, said second openings on said flexible circuit aligned with said nozzle member openings; and an encapsulant in the openings of said nozzle member and the second openings of said flexible circuit for protecting said electrical traces and electrodes.

DETAILED DESCRIPTION OF THE PREFERRED EMBODIMENTS

Figure 1:
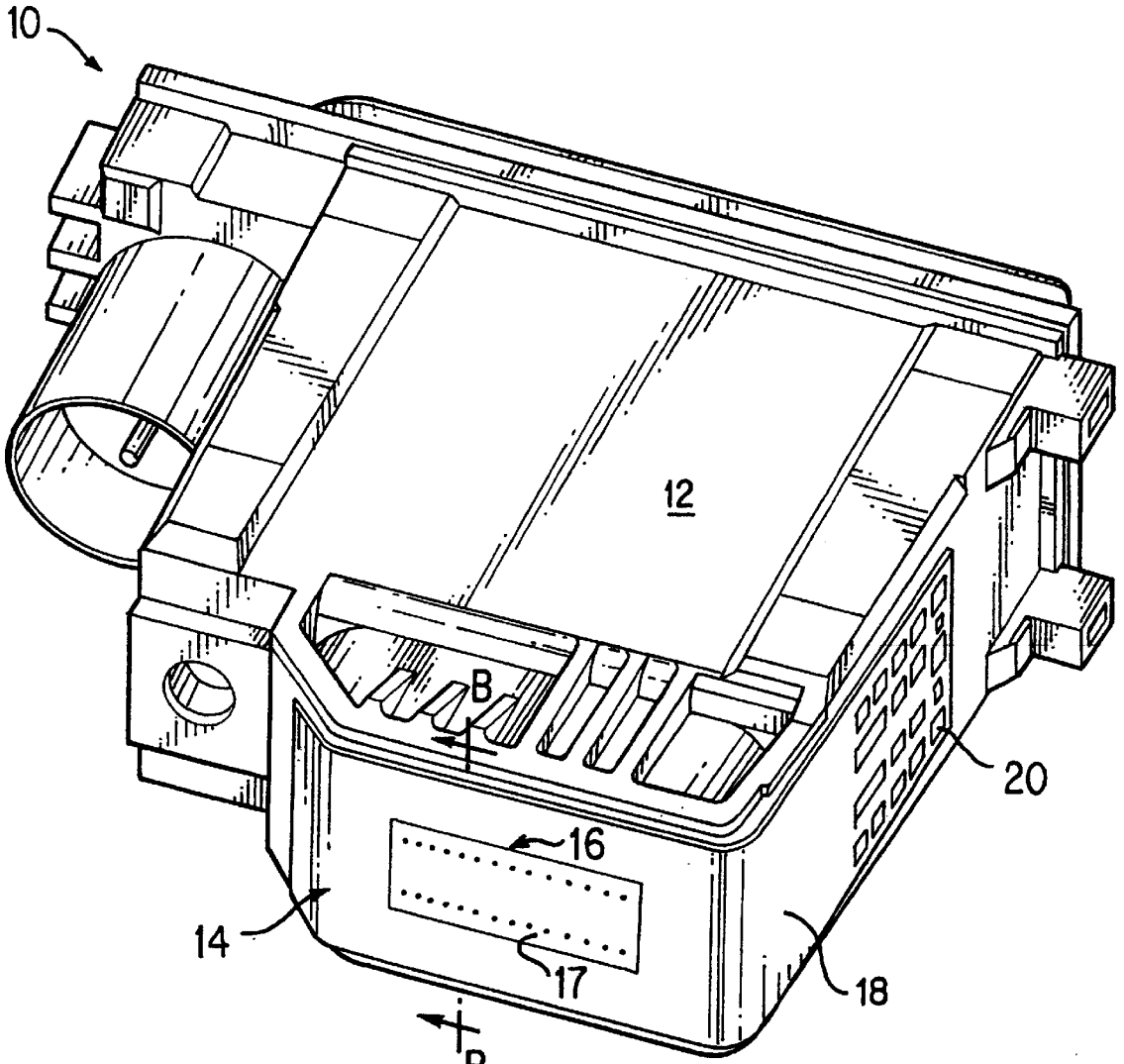
FIG. 1 is a perspective view of an inkjet print cartridge.

Referring to FIG. 1, reference numeral 10 generally indicates an inkjet print cartridge incorporating a printhead according to one embodiment of the present invention. The inkjet print cartridge 10 includes an internal ink reservoir (not shown) and a printhead formed using Tape Automated Bonding (TAB). The printhead or TAB head assembly 14 includes a nozzle member 16 comprising two parallel columns of offset holes or nozzles 17 formed in a flexible polymer flexible circuit 18 by, for example, laser ablation. The flexible circuit 18 provides for the routing of conductive traces 36 which are connected at one end to electrodes on a substrate and on the other end to contact pads 20. The print cartridge 10 is designed to be installed in a printer so that the contact pads 20 on the front surface of the flexible circuit 18, contact printer electrodes providing externally generated energization signals to the printhead.

Figures 2A, 2B:
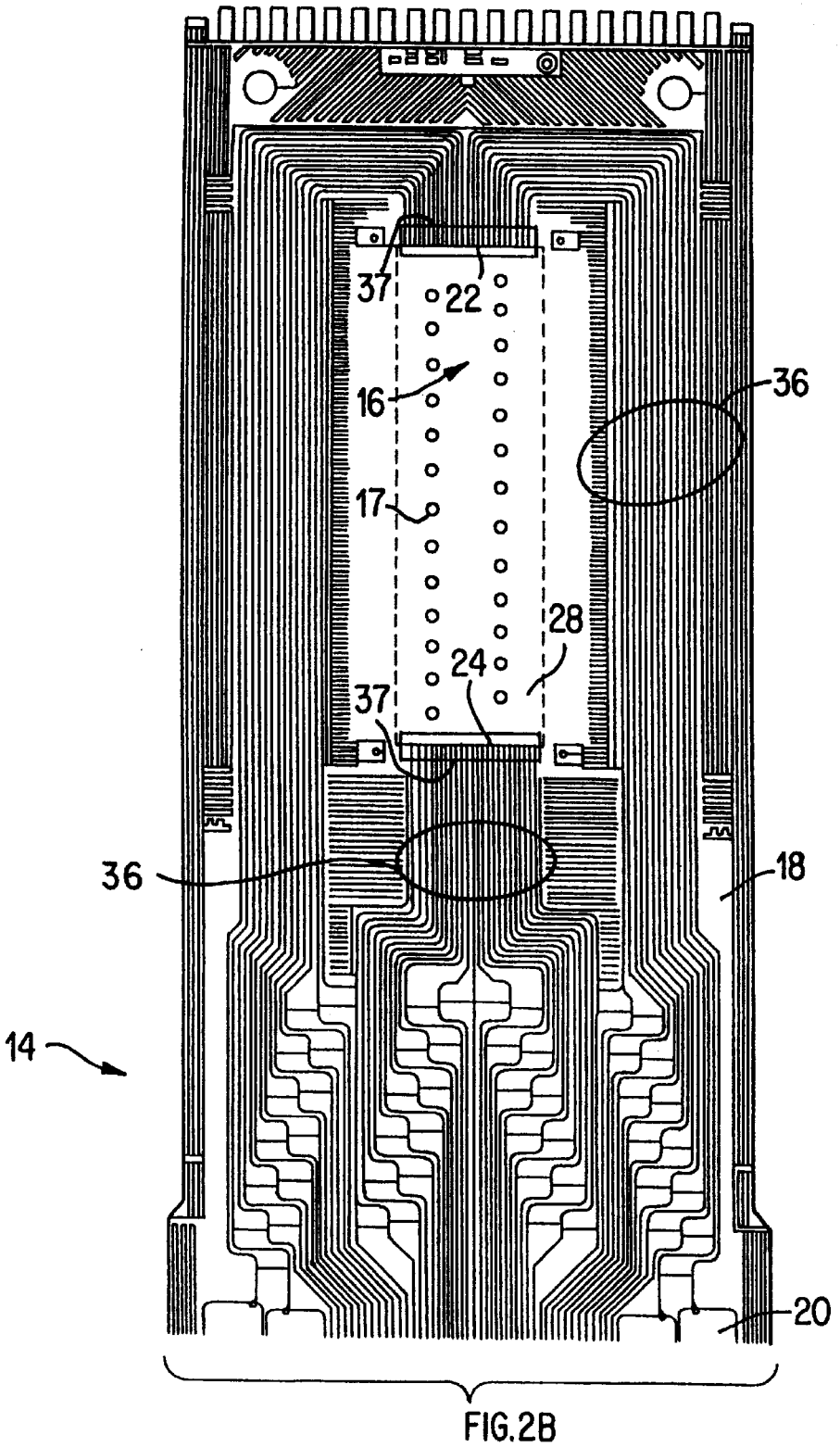
FIG. 2 is a plan view of the front surface of a printhead assembly removed from a print cartridge.
Figures 2A, 2B:
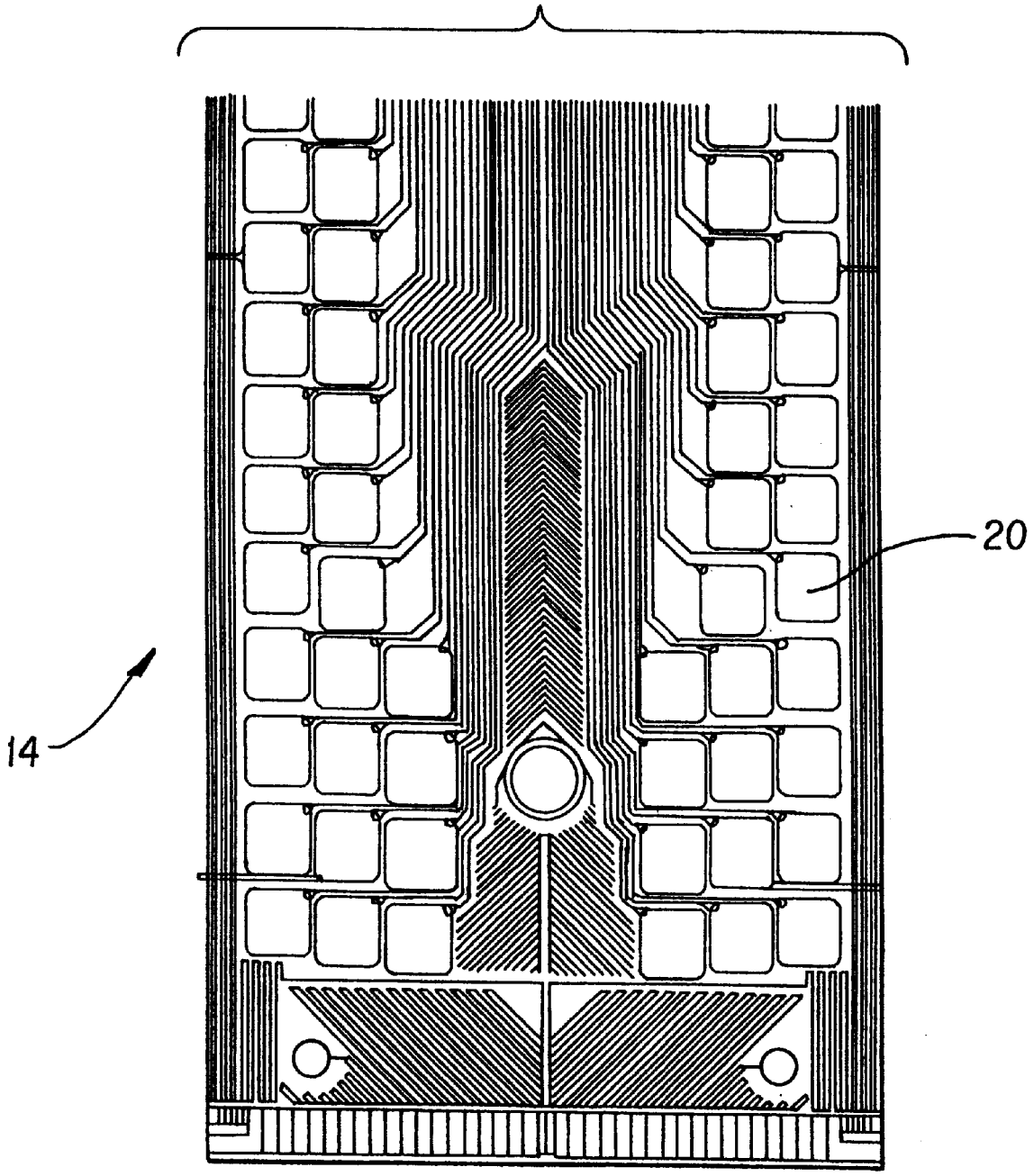

FIG. 2 shows a front view of a TAB head assembly 14 removed from a print cartridge 10. TAB head assembly 14 has affixed to the back of the flexible circuit 18 a silicon substrate 28 containing a plurality of individually energizable ink ejection elements. Each ink ejection element is located generally behind a single orifice 17 and acts as an ohmic heater when selectively energized by one or more pulses applied sequentially or simultaneously to one or more of the contact pads 20.

Flexible circuit leads 37 are bonded to pads or electrodes 40 on the outer edges of the substrate 28. To enable this bonding, a windows 22, 24 which extend through the flexible circuit 18 are created in the flexible circuit 18 to allow a bonder thermode to apply force and temperature to the flexible circuit leads 37 that are resting on the bond pads 40. The windows 22, 24 in the TAB head assembly 14 are chemically milled in the flexible circuit 18. Earlier during intermediate assembly of the TAB head assembly 14 after the leads 37 have been bonded to the bond pads 40, an encapsulant 34 is dispensed across the windows 22, 24 from the top to protect the exposed bond pad region from intrusion of ink or contamination.

The portion of the windows 22, 24 which are off the substrate extend back approximately to the location on the flexible circuit 18 where the laminated cover layer 38 of the flexible circuit 18 terminates. Thus, the openings in windows 22, 24 must be large enough to be open near the end of the cover layer 38 so that the leads 37 without any cover layer 38 are fully encapsulated by adhesive 90 and encapsulant 34. For additional details on intermediate assembly, see U.S. Pat. No. 5,442,384, entitled "Integrated Nozzle Member and TAB Circuit for Inkjet Printhead;" and U.S. Pat. No. 5,278,584 to Keefe, et al., entitled "Ink Delivery System for an Inkjet Printhead;" which are herein incorporated by reference.

The nozzles 17 and conductive traces 36 may be of any size, number, and pattern, and the various figures are designed to simply and clearly show the features of the invention. The relative dimensions of the various features have been greatly adjusted for the sake of clarity.

Figure 3:
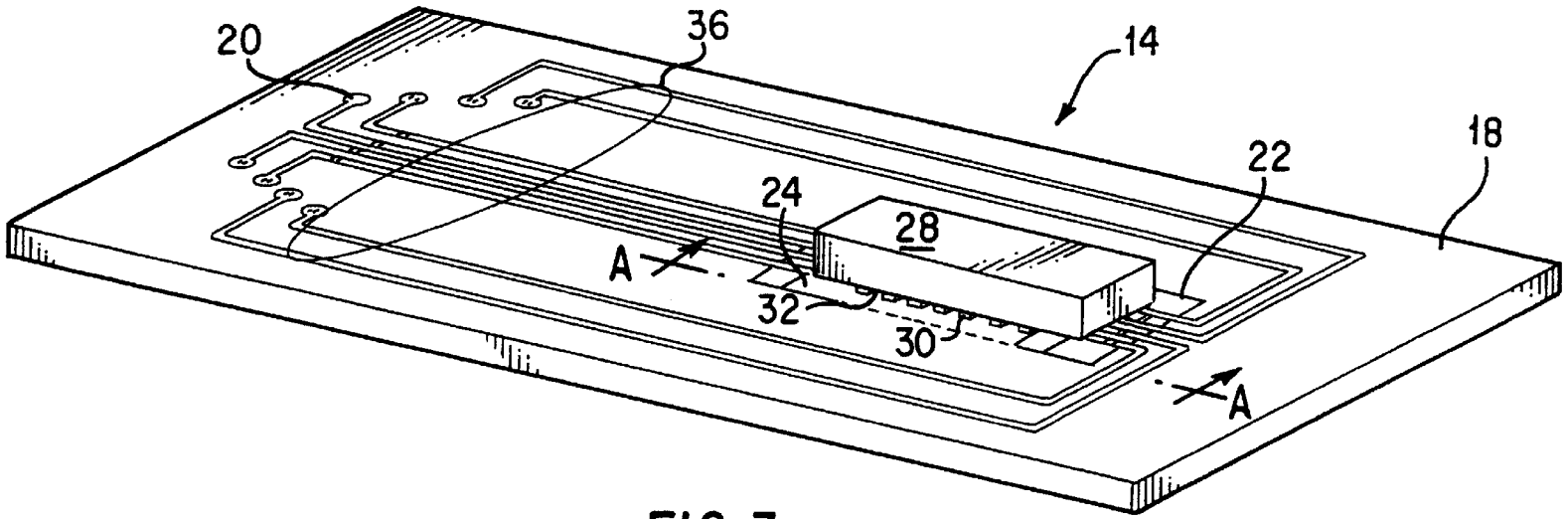
FIG. 3 is a highly simplified perspective view of the back surface of the printhead assembly of FIG. 2 with a silicon substrate mounted thereon and the conductive leads attached to the substrate.

FIG. 3 shows a highly simplified view of the back surface of a TAB head assembly 14. The back surface of the flexible circuit 18 includes conductive traces 36 formed thereon using a conventional photolithographic etching and/or plating process. The silicon die or substrate 28 is mounted to the back of the flexible circuit 18 with the ink ejection chambers 32 aligned with the nozzles or orifices 17. The conductive traces 36 are terminated by leads 37 that are bonded to bond pads or electrodes 40 on the substrate 28 and on the other end by contact pads 20 as discussed above. Also shown is one edge of the barrier layer 30 containing ejection chambers 32 formed on the substrate 28. Shown along the edge of the barrier layer 30 are the entrances to the ejection chambers 32 which receive ink from an internal ink reservoir within the print cartridge 10.

Figure 4:
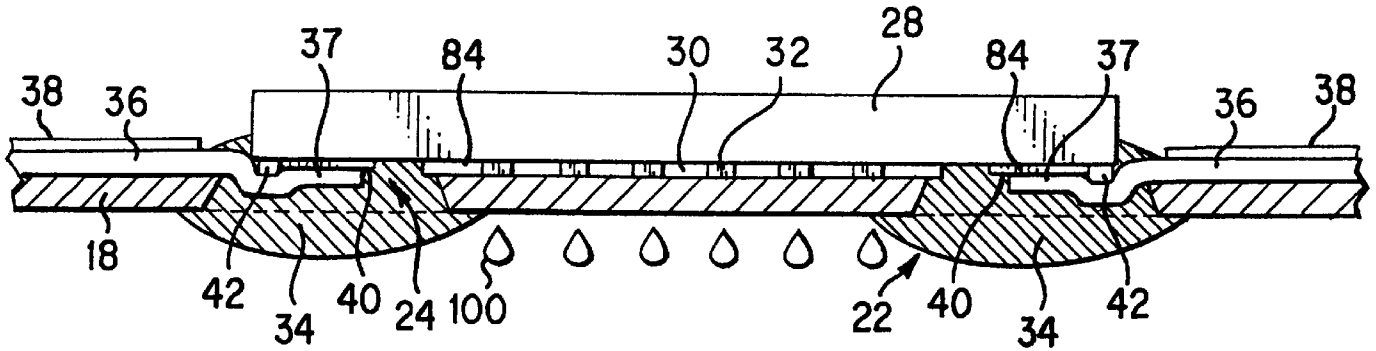
FIG. 4 is a side elevational view in cross-section taken along line A—A in FIG. 3 illustrating the attachment of conductive leads to electrodes on the silicon substrate for an integrated flexible circuit and nozzle member.

FIG. 4 shows a side view cross-section taken along line A—A in FIG. 3 illustrating the connection of the leads 37 of the conductive traces 36 to the electrodes 40 formed on the substrate 28. A portion 42 of the barrier layer 30 is used to insulate the conductive traces 36 from the substrate 28. Also shown is the flexible circuit 18, the barrier layer 30, the windows 22 and 24 and the entrances to the ink ejection chambers 32. Also shown is the encapsulant 34 that is dispensed into the windows 22, 24 after bonding of the leads 37 to the bond pads 40 to insulate the leads 37 and conductive traces 36. Droplets of ink 100 are shown being ejected from nozzles 17 associated with each of the ink ejection chambers 32.

Figure 5:
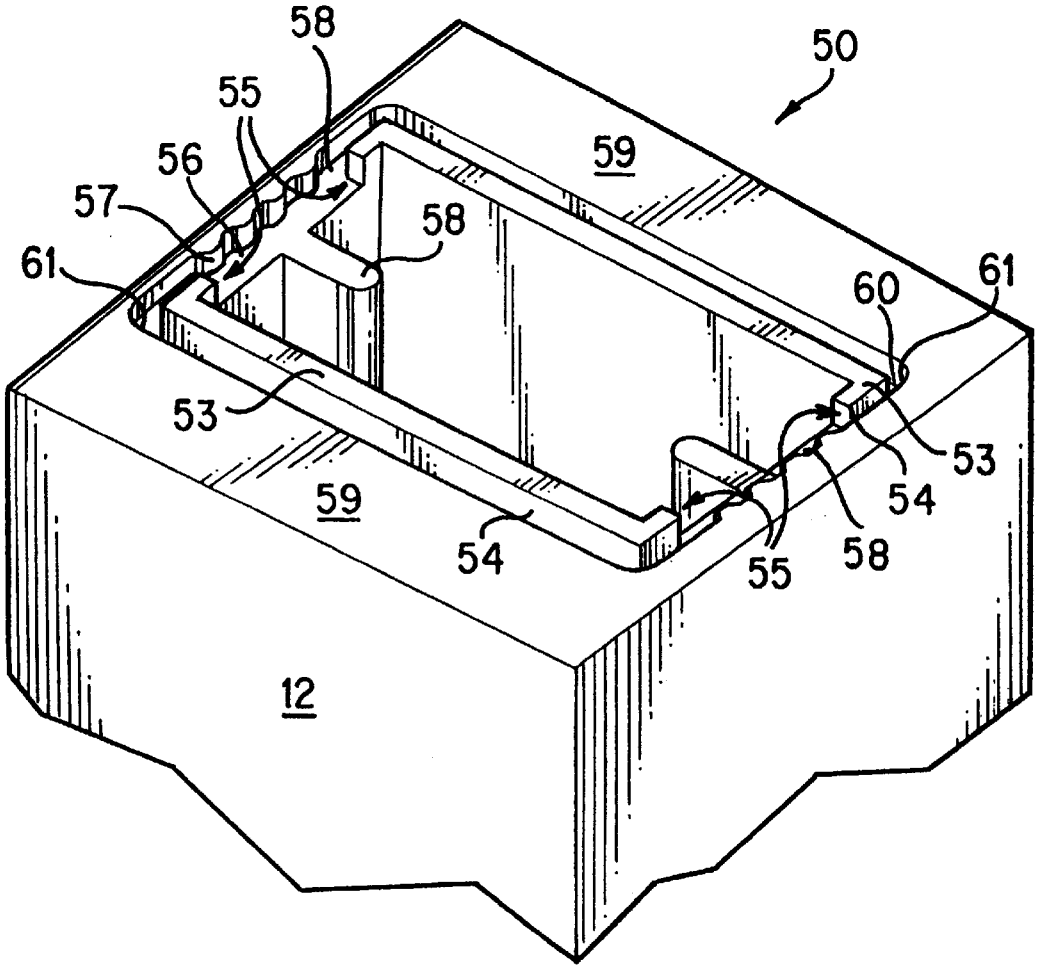
FIG. 5 is a perspective view of the headland area of the inkjet print cartridge of FIG. 1 with the printhead assembly removed.

FIG. 5 shows the headland area 50 of the print cartridge body 12 of FIG. 1 in a perspective view and with the TAB head assembly 14 removed to reveal the headland design used in providing a seal between the TAB head assembly 14 and the body 12 of the print cartridge 10. Shown are an inner raised wall 54, an adhesive support surface 53 on the inner raised wall, openings 55 in the inner raised wall 54, a substrate support surface 58, a flat top surface 59 and a gutter 61. Also shown are adhesive ridges 57 and the area 56 on the substrate support surface 58 between the adhesive ridges 57. Adhesive 90 is dispensed along the adhesive support surface 53 of inner raised wall 54 and across substrate support surface 58 in the wall openings 55 of the inner raised wall 54 and adjacent to and suspended off adhesive ridges 57.

As the TAB head assembly 14 is pressed down onto the headland 50, the adhesive 90 is squished down. The adhesive squishes through the wall openings 55 in the inner raised wall to encapsulate the traces leading to electrodes on the substrate. The adhesive 90 also squishes both inwardly and upwardly through the windows 22, 24 and flush with the bottom surface of the encapsulant and partially encapsulates the exposed leads 37.

This seal formed by the adhesive 90 circumscribing the substrate 28 allows ink to flow around the sides of the substrate 28 to the ejection chambers 32 formed in the barrier layer 30, but prevents ink from seeping out from under the TAB head assembly 14. Thus, this adhesive seal 90 provides a strong mechanical coupling of the TAB head assembly 14 to the print cartridge 10, a fluidic seal and flexible circuit trace 36 encapsulation.

Figure 6:
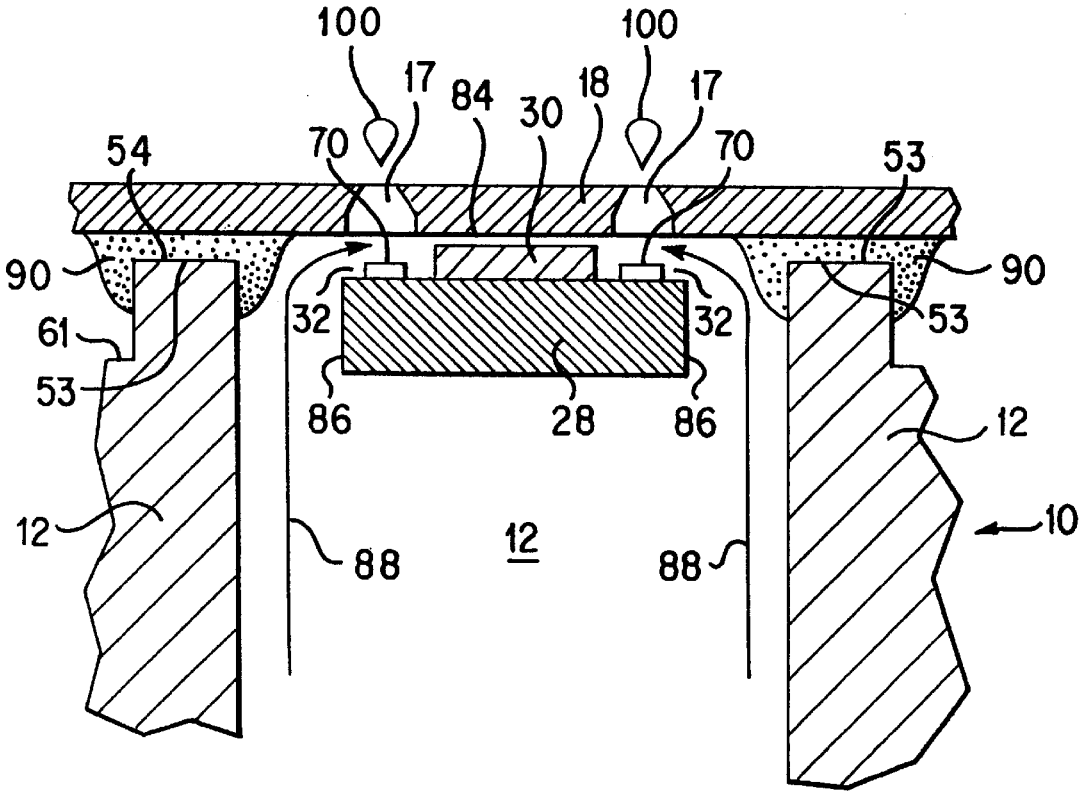
FIG. 6 is a schematic cross-sectional view taken along line B—B of FIG. 1 showing the printhead assembly and the print cartridge body.

FIG. 6 is a cross-sectional view taken along line B—B of FIG. 1 showing ink ejection chambers 32, ink ejection elements 70, and nozzles 17 after the barrier layer 30 and substrate 28 are secured to the back of the flexible circuit 18 at location 84 and the flexible circuit is secured to the body of the print cartridge 10 by adhesive 90. A side edge of the substrate 28 is shown as 86. In operation, ink flows from reservoir 12 around the side edge 86 of the substrate 28, and into ink ejection chamber 32, as shown by the arrow 88. Upon energization of the ink ejection element 70, a thin layer of the adjacent ink is superheated, causing a droplet of ink 100 to be ejected through the orifice 17. The ink ejection chamber 32 is then refilled with ink by capillary action. Also shown is a portion of the adhesive seal 90, applied to the inner raised wall 54 surrounding the substrate 28.

In a typical inkjet printhead assembly the flexible circuit 18 serves both as the nozzle member 16 and as the carrier of the conductor traces 36. There are several fundamental problems with this design approach. First, the nozzle member 16 material, thickness and manufacturing processes cannot be optimized independently from that of the flexible circuit 18, even though each has very different functional requirements. Second, the conductor traces 36 must be protected with a cover layer 38 to prevent electrical shorting and corrosion. Third, it is difficult to design a cover layer 38 and an adhesive 90 that is resistant to a wide range of inks while also having good adhesion to both the print cartridge 10 body and flexible circuit 18 material. Fourth, most printhead-to-headland adhesives de-laminate from the flexible circuit 18 over time. When this occurs, inks can readily penetrate the cover layer 38 and adhesive 90 to cause electrical shorting and corrosion. Fifth, as shown in FIG. 4, in edge-feed print cartridges there is an unprotected region between the end of the cover layer 38 and the substrate 28. Here, the conductor traces 36 are susceptible to shorting and corrosion if ink penetrates between the structural adhesive 90 and the flexible circuit 18.

More importantly, prior printhead designs have not addressed the problem of dimples being created in nozzle member 16 and flexible circuit 18 of TAB head assembly 14 by the bending or deformation of the nozzle member 16 and flexible circuit 18 due to the stresses created by the adhesive process of sealing the nozzle member 16 to the headland 50 of the print cartridge 10. This dimpling of the nozzle member 16 creates nozzles 17 which are skewed causing trajectory errors for the ejected ink droplets from the nozzles. Also, the nozzle member 16 is susceptible to wiper induced ruffles around the nozzle 17 exits which adversely affect drop ejection performance and thus print quality.

In addition, the flexible circuit 18 thickness has to be matched to the other printhead parameters such as the dimensions of the ink ejection chamber 32, ink ejection element 70, barrier layer 30 thickness, nozzle diameters, as well as the ink formulation. Simply reducing the above dimensions reduces the volume of the ejected drops, but creates ink drops with a low ejection velocity. A standard two mil (50.8 micron) flexible circuit 18 creates a long nozzle when the dimensions are decreased to obtain low drop volumes. Consequently, drops are ejected at a velocity which is too low. Accordingly, a one mil flexible circuit 18 needs to be used in order to obtain sufficient drop ejection velocity. However, a one mil flexible circuit being one-half as thick and has less stiffness than a two mil flexible circuit. Therefore, dimpling and bending of the flexible circuit 18 and wiper induced ruffles around the exit of nozzles 17 is increased. Moreover, matching flexible circuit thickness to nozzle length limits design freedom because the thickness independent of the thickness of the flexible circuit and nozzle member have different functional requirements. Accordingly, it would be advantageous to adjust the nozzle member 16 thickness independent of the thickness of the flexible circuit 18.

By decoupling the nozzle member from the flexible circuit there is freedom to use a thin stiff material for the nozzle member 16 and a thicker flexible material for the flexible circuit 18. As discussed above, thin nozzle members are needed with very low drop volume print cartridges to achieve drop velocities comparable to higher drop volume print cartridges. If the drop velocity is too low, image quality will be degraded.

Figure 7:
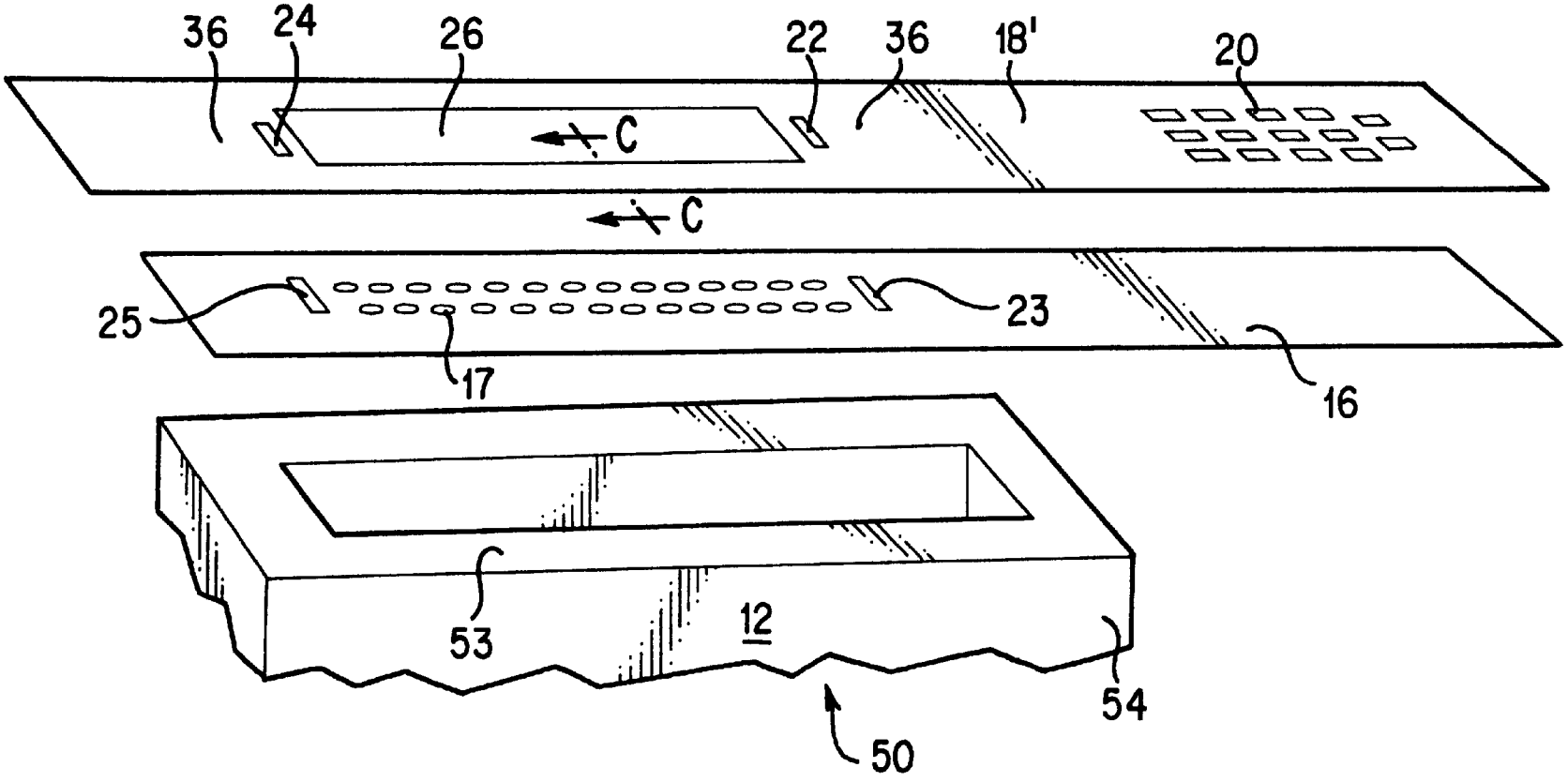
FIG. 7 is a schematic perspective view of a decoupled flexible circuit and nozzle member and the headland area of a print cartridge body.
Figure 8:
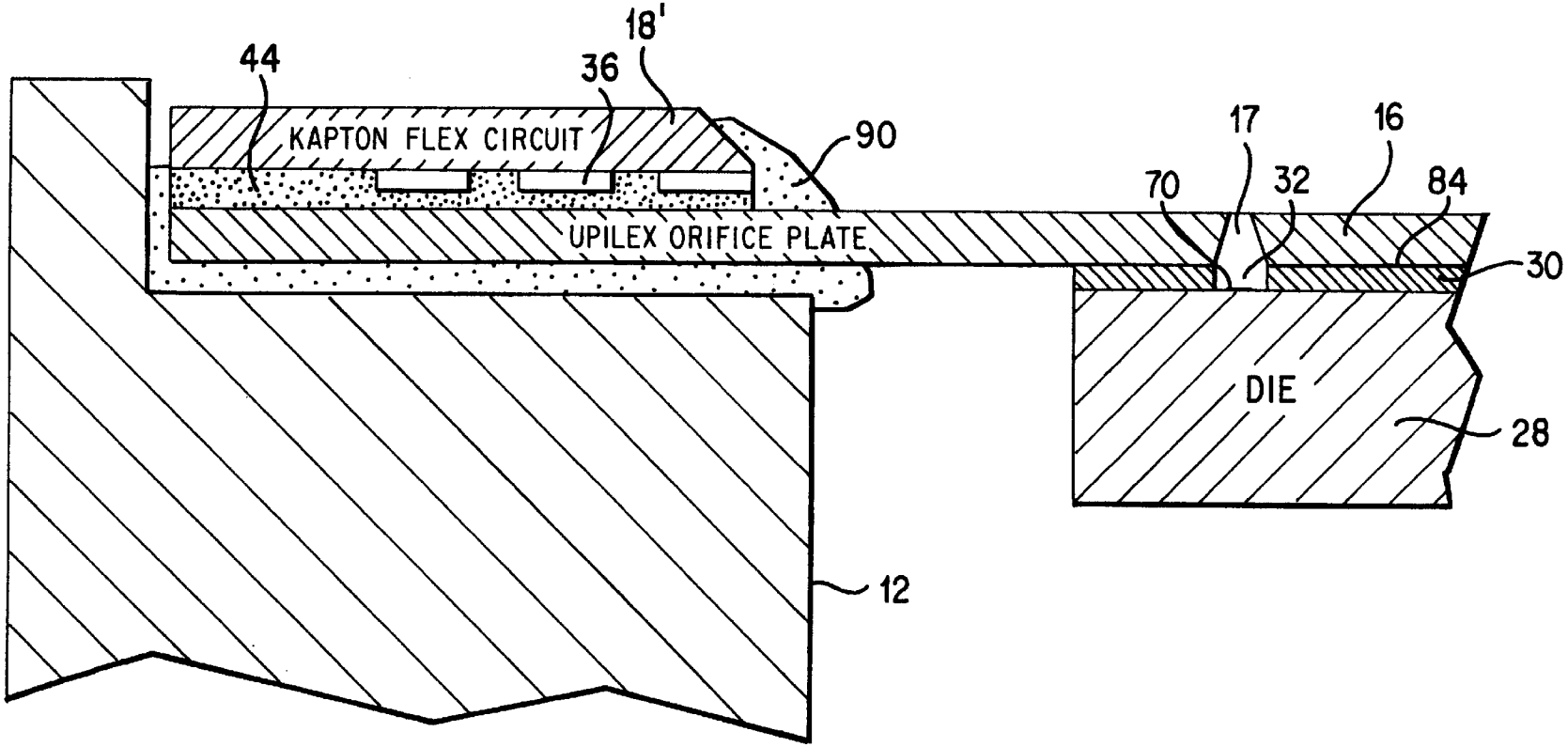
FIG. 8 is a schematic cross-sectional view taken along line B—B of FIG. 1 showing a decoupled printhead assembly and the print cartridge body.
Figure 9:
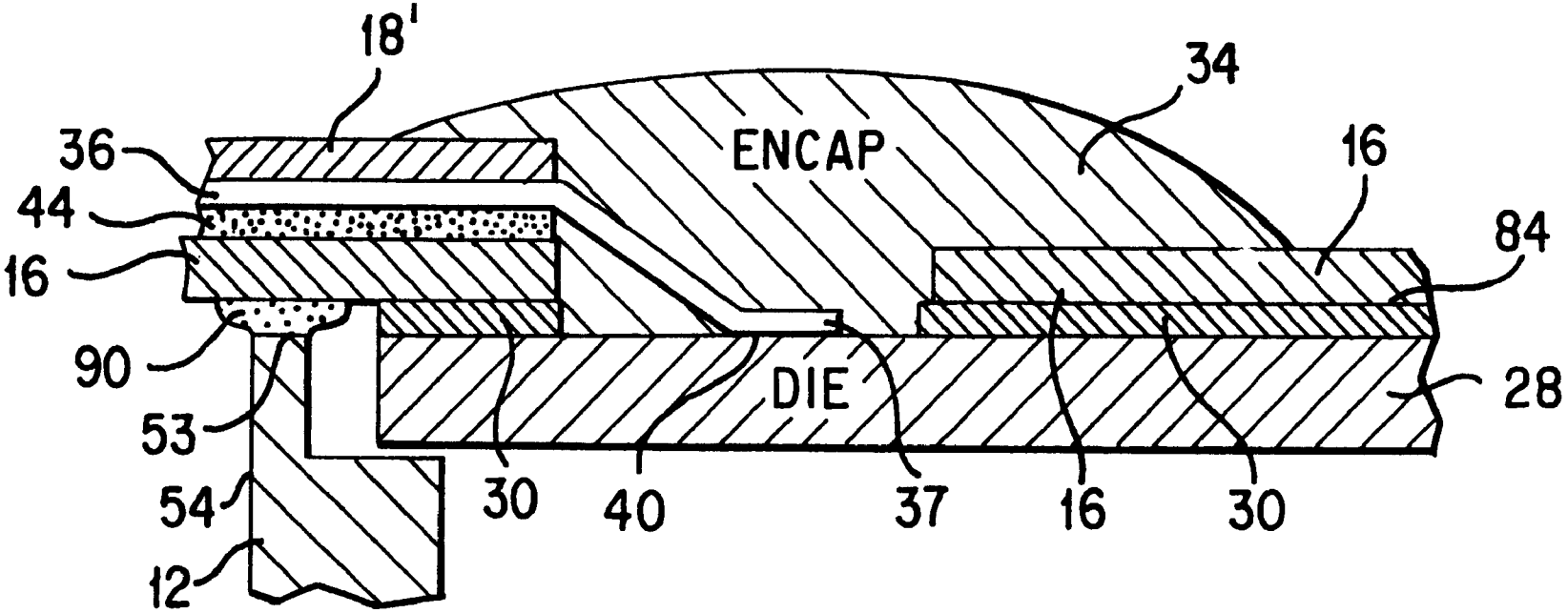
FIG. 9 is a side elevational view in cross-section illustrating the attachment of conductive leads to electrodes on the silicon substrate for a decoupled flexible circuit and nozzle member.

FIGS. 7, 8 and 9 illustrate the decoupled nozzle member-flexible circuit printhead assembly 14 of the present invention. Referring to FIG. 7, the present invention is a de-coupled printhead assembly 14 wherein the nozzle member 16 has the ablated nozzles 17 and the flexible circuit 18' carries the conductive traces 36. Accordingly, the nozzle member 16 and the flexible circuit 18' may be made of different materials based on the individual functional requirements of the flexible circuit and nozzle member. Suitable materials for the nozzle member 16 and flexible circuit 18' include teflon, polyimide, polymethylmethacrylate, polycarbonate, polyester, polyimide polyethylene-terephthalate or mixtures thereof. In a preferred embodiment of the present invention, the de-coupled the flexible circuit 18' can be made of a flexible material such as Kapton™ while the nozzle member 16 can be constructed of a stiffer, more ink resistant material such as Upilex™ polyimide. Upilex has better dimensional retention over life and is less susceptible to dimpling and wiper induced ruffles around the nozzle 17 exits which adversely affect drop ejection performance and thus print quality.

Referring to FIG. 7, the flexible circuit 18' is aligned and positioned with respect to de-coupled nozzle member 16 so that the opening 26 in the flex circuit is aligned with the array of nozzles 17 in the nozzle member 16 and so that the windows 22, 24 in the flex circuit 18' are aligned with the windows 23, 25 in the nozzle member. The nozzle member 16 and the flexible circuit 18' may be joined together with an adhesive 44 (shown in FIGS. 8 and 9) or by heat staking. In this decoupled printhead assembly, the active conductor traces 36 are still on the bottom side of the flexible circuit 18', but conductor traces 36 are protected by the nozzle member 16 which is attached to the bottom side of the flexible circuit 18'. Accordingly, the cover layer 38 covering the conductive traces 36 may be eliminated. Also shown in FIG. 7 is a highly schematic drawing of the headland area of the print cartridge body 12.

FIG. 8 is a schematic cross-sectional view taken along line B—B of FIG. 1 showing a decoupled printhead assembly 14 and the print cartridge body 12. FIG. 9 is a side elevational view in cross-section illustrating the attachment of conductive leads 37 to electrodes 40 on the silicon substrate 28 in the window 22, 24 in the flexible circuit 18' and the window 23, 25 in the nozzle member 16.

Referring to FIG. 8, the substrate 28 is aligned and positioned with respect to the back surface of the de-coupled nozzle member 16 so as to align the ink ejection chambers 32 formed in the barrier layer 30 and the ink ejection elements 70 formed on the substrate 28 with the nozzles 17 formed in the decoupled nozzle member 16. Referring to FIG. 9, this alignment step also inherently aligns the electrodes 40 on the substrate 28 with the leads 37 of the conductive traces 36 on flexible circuit 18' which has been previously affixed to the nozzle member 16. The top surface 84 of the barrier layer 30 is then affixed to the back surface of the decoupled nozzle member 16 by heat bonding or an adhesive. The conductive traces 36 are then bonded to the electrodes 40 and the encapsulant 34 is dispensed into the windows 22, 24 and 23, 25 as shown in FIG. 9. The printhead assembly 14 is then attached to the headland area 50 of the print cartridge body 12 as discussed above.

Referring to FIG. 9, the unprotected region between the end of the cover layer 38 and the substrate 28 (see FIG. 4) is eliminated. With the de-coupled printhead assembly 14 of the present invention, the nozzle member 16 and adhesive 44 act as the protective layer. However, unlike the cover layer 38, the nozzle member 16 does not terminate near the end of the substrate 28, but is continuous across the entire headland area 50, thus providing a barrier between the ink and the conductor traces 36 which now are located above the nozzle member 16.

By eliminating the cover layer 38, the substrate 28 is exposed to fewer thermal stresses during manufacturing. During manufacturing of the print cartridge constructed as in FIGS. 2–4, the protective cover layer 38 is applied after substrate 28 attachment to the flexible circuit 18. With the present invention, the flexible circuit 18' and the nozzle member 16 are joined prior to substrate 28 attachment and the need for a multi-layer protective cover layer 38 and its associated thermal curing are eliminated.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An inkjet printhead comprising:

a substrate having a plurality of individual ink ejection chambers defined by a barrier layer formed on a first surface of said substrate and having an ink ejection element formed on the first surface of said substrate in each of said ink ejection chambers, said ink ejection elements electrically connected to electrodes on said substrate;

a nozzle member constructed of a first material having a predetermined thickness and having a plurality of nozzles formed therein, said nozzle member overlaying and affixed to said barrier layer such that said nozzles align with said ink ejection chambers and said ink ejection elements, said nozzle member including openings aligned with and exposing the electrodes on said substrate;

a flexible circuit constructed of a second material and having electrical traces formed thereon, said flexible circuit overlying and affixed to said nozzle member such that a first opening therein exposes said plurality of nozzles, said flexible circuit including second openings therein for exposing the electrical traces bonded to the electrodes, said second openings on said flexible circuit aligned with said nozzle member openings; and an encapsulant in the openings of said nozzle member and the second openings of said flexible circuit for protecting said electrical traces and electrodes.

2. The inkjet printhead of claim 1 wherein the thickness of the nozzle member is based on printhead parameters and is independent of the thickness of the flexible circuit.

3. The inkjet printhead of claim 1 wherein the first material is more rigid than the second material.

4. The inkjet printhead of claim 1 wherein the nozzle member provides a protective barrier for the conductive traces and leads on the flexible circuit.

5. The inkjet printhead of claim 1 wherein said nozzle member extends over two or more outer edges of said substrate.

6. The inkjet printhead of claim 1 wherein said nozzle member is affixed to said barrier layer with an adhesive.

7. The inkjet printhead of claim 1 wherein said nozzle member is affixed to said barrier layer by heat bonding.

8. The inkjet printhead of claim 1 wherein said flexible circuit is affixed to said nozzle member with an adhesive.

9. The inkjet printhead of claim 1 wherein said flexible circuit is affixed to said nozzle member by heat bonding.

10. The inkjet printhead of claim 1 wherein the first material is selected from the group consisting of teflon, polyimide, polymethylmethacrylate, polycarbonate, polyester, polyimide polyethylene-terephthalate or mixtures thereof.

11. The inkjet printhead of claim 1 wherein the second material is selected from the group consisting of teflon, polyimide, polymethylmethacrylate, polycarbonate, polyester, polyimide polyethylene-terephthalate mixtures thereof.

12. A method of assembling an inkjet printhead, comprising:

providing a substrate having a plurality of individual ink ejection chambers defined by a barrier layer formed on a first surface of said substrate and having an ink ejection element formed on the first surface of said substrate in each of said ink ejection chambers, said ink ejection elements electrically connected to electrodes on said substrate;

affixing a nozzle member constructed of a first material having a predetermined thickness and having a plurality of nozzles formed therein to said barrier layer such that said nozzles align with said ink ejection chambers and said ink ejection elements, said nozzle member including openings aligned with and exposing the electrodes on said substrate;

attaching a flexible circuit constructed of a second material and having electrical traces formed thereon to said nozzle member such that a first opening therein exposes said plurality of nozzles, said flexible circuit including second openings therein for exposing the electrical traces bonded to the electrodes, said second openings on said flexible circuit aligned with said nozzle member openings; and dispensing an encapsulant into the openings of said nozzle member and the second openings of said flexible circuit for encapsulating and protecting said electrical traces and electrodes.

13. The method of claim 12 wherein the thickness of the nozzle member is based on printhead parameters and is independent of the thickness of the flexible circuit.

14. The method of claim 12 wherein the first material is more rigid than the second material.

15. The method of claim 12 wherein the nozzle member provides a protective barrier for the conductive traces and and leads the flexible circuit.

16. The method of claim 12 the first material is selected from the group consisting of teflon, polyimide, polymethylmethacrylate, polycarbonate, polyester, polyimide polyethylene-terephthalate or mixtures thereof.

17. The method of claim 12 wherein the second material is selected from the group consisting of teflon, polyimide, polymethylmethacrylate, polycarbonate, polyester, polyimide polyethylene-terephthalate or mixtures thereof.

18. An inkjet print cartridge comprising:

an inkjet printhead including, a substrate having a plurality of individual ink ejection chambers defined by a barrier layer formed on a first surface of said substrate and having an ink ejection element formed on the first surface of said substrate in each of said ink ejection chambers, said ink ejection elements electrically connected to electrodes on said substrate;

a nozzle member constructed of a first material and having a plurality of nozzles formed therein, said nozzle member overlaying and affixed to said barrier layer such that said nozzles align with said ink ejection chambers and said ink ejection elements, said nozzle member including openings aligned with and exposing the electrodes on said substrate; and a flexible circuit constructed of a second material and having electrical traces formed thereon, said flexible circuit overlying and affixed to said nozzle member such that a first opening therein exposes said plurality of nozzles, said flexible circuit including second openings therein for exposing said electrical traces bonded to said electrodes, said second openings on said flexible circuit aligned with said nozzle member openings; and an encapsulant in the openings of said nozzle member and the second openings of said flexible circuit for protecting said electrical traces and electrodes;

an ink inlet fluidically connected to said ink ejection chambers;

an ink supply;

an ink channel fluidically connecting said supply of ink with said ink inlet; and a print cartridge body having a headland portion affixed to said nozzle member.

* * * * *